US006669888B2

(12) United States Patent
Park et al.

(10) Patent No.: US 6,669,888 B2
(45) Date of Patent: Dec. 30, 2003

(54) PROCESS OF MAKING POLYPROPYLENE FIBERS

(76) Inventors: Pyung Yul Park, 103-406 Hyundai Apt., Bugok-dong, Kimchon-si, Kyongsangbuk-do (KR); Won Jun Chey, 201-607 Green Apt., Bon-dong, Talso-gu, Taegu-city (KR)

( * ) Notice: Subject to any disclaimer, the term of this patent is extended or adjusted under 35 U.S.C. 154(b) by 282 days.

(21) Appl. No.: 09/865,689

(22) Filed: May 29, 2001

(65) Prior Publication Data

US 2001/0031814 A1 Oct. 18, 2001

Related U.S. Application Data

(62) Division of application No. 09/599,878, filed on Jun. 23, 2000, now Pat. No. 6,270,892.

(30) Foreign Application Priority Data

| | | |
|---|---|---|
| Jul. 6, 1999 | (KR) | 1999-26983 |
| Nov. 10, 1999 | (KR) | 1999-49610 |
| Mar. 16, 2000 | (KR) | 2000-13319 |

(51) Int. Cl.[7] ..... D01D 5/08; D01F 1/10; D01F 6/06

(52) U.S. Cl. ..... 264/176.1; 264/210.6; 264/210.8; 264/211

(58) Field of Search ..... 264/176.1, 210.6, 264/210.8, 211

(56) References Cited

U.S. PATENT DOCUMENTS

| | | | | |
|---|---|---|---|---|
| 5,868,984 A | * | 2/1999 | Winter et al. | 264/176.1 |
| 6,416,699 B1 | * | 7/2002 | Gownder et al. | 264/210.8 |

* cited by examiner

*Primary Examiner*—Leo B. Tentoni
(74) *Attorney, Agent, or Firm*—Shanks & Herbert

(57) ABSTRACT

Process of making polypropylene fibers obtained from an isotactic polypropylene homopolymer with an isotactic index of 90–99%, through melt-spinning or through drawing after melt-spinning, and shows two differential scanning calorimeter (DSC) endothermic peaks between 155 and 170 ° C. When being thermally bonded with each other, the fibers are made into non-woven fabrics which have excellent strength in addition to being soft. A high quality of the non-woven fabrics can be produced in a high speed carding machine with high yields.

9 Claims, 3 Drawing Sheets

PROCESS OF MAKING POLYPROPYLENE FIBERS

This is a division of application Ser. No. 09/599,878, filed Jun. 23, 2000 now U.S. Pat. No. 6,270,892.

BACKGROUND OF THE INVENTION

1. Field of the Invention

The present invention relates, in general, to a polypropylene fiber and, more particularly, to a polypropylene fiber which is useful as a material for non-woven fabrics, thereby allowing the non-woven fabrics to be smooth and excellent in strength and providing workability and physical properties for the non-woven fabrics during after-processes. Also, the present invention is concerned with a method for preparing such fibers.

2. Description of the Prior Art

In order that staple fibers are prepared from polyolefin polymers, they have to undergo a series of processes: the polyolefin polymers are generally compounded with some amount of additives and the resulting mixtures are melt-extruded in ordinary commercial processes to give fibers, which are crimped and cut into predetermined lengths.

When being applied for the making of non-woven fabrics, polyolefin staples are typically processed in a carding machine to give non-woven webs which are then thermally bonded.

For thermal bonding, a pair of calender rollers, ultrasonification, or hot air is usually used.

Particularly as for polypropylene filaments or staples, they are arranged after opening and carding processes, and bridged to afford webs. These webs are thermally bonded with the aid of a calender roller with diamond or delta type patterns to produce non-woven fabrics which are industrially useful in various fields. Alternatively, hot air may be utilized instead of calender rollers. In this case, after being allowed to undergo a carding process, webs are bonded to give non-woven fabrics by means of hot air which is circulated in a porous drum.

Polypropylene non-woven fabrics find numerous applications in the disposable diaper, diaper for patients suffering from urinary incontinence, hygienic band, mask, and medical fabric industries. Although not demanding strength as high as that of woven fabrics, the non-woven fabrics used in these purposes have to be soft and satisfy the requirement of safety to skin because they are in direct contact with the skin.

The strength of non-woven fabrics varies depending on their preparation processes as well as on physical properties of material fibers.

With the aim of improving productivity, non-woven fabric producing manufacturers generally try to make high production speed. The high production speed, however, demands more excellent physical properties for the fibers for non-woven fabrics.

SUMMARY OF THE INVENTION

Leading to the present invention, the intensive and thorough research on polypropylene yarns or staples suitable for non-woven fabrics, repeated by the present inventors aiming to overcome the above problems encountered in prior arts, resulted in the finding that isotactic polypropylene homopolymers, which are found to have two endothermic peaks as measured by a differential scanning calorimeter (DSC), allow the production of novel fibers, which have been not yet reported in any arts, and guarantee the excellent strength and softness of the non-woven fabrics prepared from the fibers. In addition, the fibers of such a structure were found to be obtained by controlling melting indexes and polydispersity indexes in each process step through the total procedure.

Therefore, it is an object of the present invention to provide polypropylene fibers for non-woven fabrics, which can be applied to high-speed carding machines and guarantee the excellent strength and softness of the non-woven fabrics after thermal bonding.

It is another object of the present invention to provide a method for preparing such polypropylene fibers.

It is a further object of the present invention to provide a non-woven fabric prepared from such polypropylene fibers.

In accordance with an embodiment of the present invention, there is provided a polypropylene fiber, which is obtained from an isotactic polypropylene homopolymer with an isotactic index of 90 to 99% through melt-scanning or through drawing after melt-spinning, and shows two differential scanning colorimeter (DSC) endothermic peaks between 155 and 170° C.

In accordance with another embodiment of the present invention, there is provided a method for preparing polypropylene fibers, comprising the steps of: (a) melting an isotactic polypropylene homopolymer with an isotactic index of 90–99%, a melting index ($MI_a$) of 10.0–40.0 and a polydispersity index ($PI_a$) of 2.5–6.0 to give a melt with a melt index ($MI_b$) of 10.1–41.0 and a melt index ($PI_b$) narrower by 10% or less than the $PI_a$, the ratio of $MI_b/MI_a$ ranging from 1.01 to 1.50; (b) spinning the molten polymer to produce fibers with a melting index ($MI_c$) of 16.5–80.0 and a polydispersity index ($PI_c$) narrower by 20% or less than the $PI_a$, the ratio of $MI_c/MI_a$ ranging from 1.65 to 7.50; and (c) optionally drawing the fibers.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
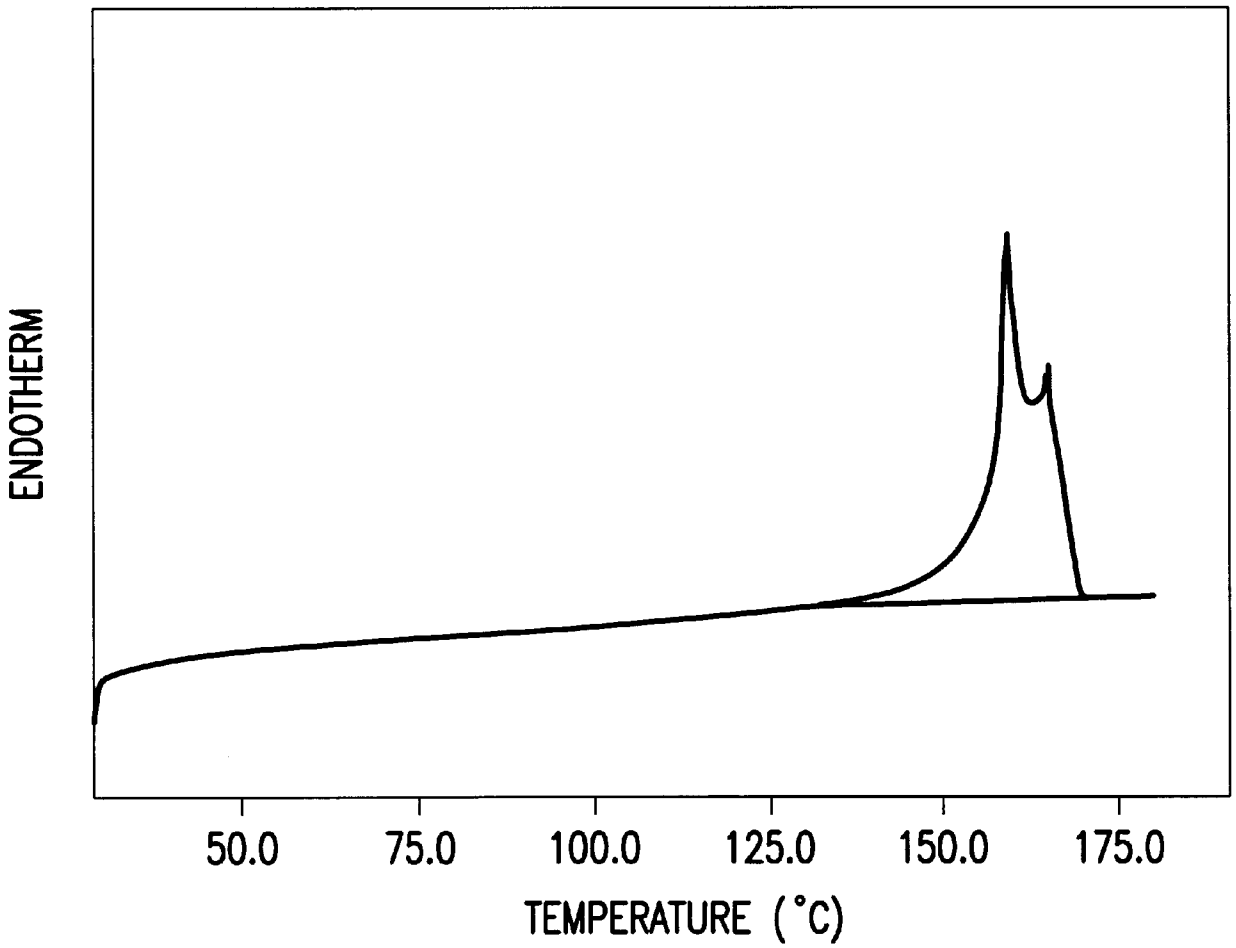
FIG. 1 is a DSC endothermic curve in which two endothermic peaks apparently appear in a polypropylene homopolymer fiber of the present invention as measured by a DSC.

The present invention pertains to polypropylene fibers which are prepared from polypropylene homopolymers with an isotactic index of 90 to 99% by melt-spinning or by melt-spinning and drawing and have two differential scanning colorimeter (DSC) endothermic peaks in the range from 155 to 170° C. Preferably, the polypropylene fibers of the present invention show a primary endothermic peak at 160±3° C. and a secondary endothermic peak at 165±3° C.

Where non-woven fabrics are prepared from the polypropylene fibers of the present invention by thermal bonding, the above physical properties allow the non-woven fabrics to be smooth with excellent strength. This advantage is believed to result from the fact that, while the fibers thermally fused due to the heat or the heat and the pressure between rolls are solidified again, rapid recrystallization occurs in the regions which are high in melting points.

Useful as materials to prepare the fibers of the present invention are polypropylene homopolymers with an isotactic index of 90 to 99%.

The polypropylene fibers of the present invention have a melt index ($MI_c$) of 16.5–80.0, which is preferably 1.65–7.50 times as large as that ($MI_a$) of the material isotactic polypropylene.

Preferably, the polypropylene fibers of the present invention range, in polydispersity index ($PI_c$), from 2.1 to 5.7 and, more preferably from 3.5 to 4.3 with a value being narrower by 20% than that of the material isotactic polypropylene fiber.

A preferable fineness that the polypropylene fibers of the present invention have falls in the range of 1.0 to 80.0 deniers.

As for the isotactic polypropylene used in the present invention, it preferably ranges, in melt index ($MI_a$), from 10 to 40 and, in polydispersity index ($PI_a$), from 2.5 to 6.0.

When the polypropylene is melted in an extruder, a stabilizer or an antioxidant is preferably formulated at an amount of 0.03 to 2.0 wt %, preferably 0.03 to 0.7 wt % and more preferably 0.03 to 0.4 wt %.

In addition to stabilizers or antioxidants, ordinary additives in the art, such as a deoxidant agent, a colorant, metal carboxylates, etc., may be used for the preparation of the fibers of the present invention. The metal carboxylate available in the present invention is selected from the group consisting of nickel salts of 2-ethyl hexanoic acid, caprylic acid, decanoic acid, and dodecanoic acid, Fe, Co, Ca and Ba salts of 2-ethyl hexanoic acid, and combinations thereof. As the deoxidant agent or the colorant, calcium stearate, which is usually used to prepare polypropylene homopolymers in petrochemical plants, may be selected. A variety of additives available in the present invention may be referred to European patent No. 279,511.

The isotactic polypropylene useful in the present invention, as previously mentioned, preferably has a melt index ($MI_a$) of 10 to 40. For example, when the $MI_a$ is below 10, an increase occurs in the spinneret pressure upon spinning, giving rise to a decrease in productivity. A high heat is required for the melt-spinning of such polypropylene, resulting in an increase in energy consumption. In addition, the fibers obtained under such a high heat show increased tenacity, so that they are not suitable for the non-woven fabric uses which require smoothness. On the other hand, when the isotactic polypropylene has an $MI_a$ of greater than 40, the resulting fibers are not suitable for non-woven fabrics in terms of strength. Further, incompletion frequently occurs in the fulfillment of quenching after the spinning, leading to fusion between neighboring fibers.

It should be noted that the fibers of the present invention include those which are obtained through melting, spinning, solidifying and taking-up processes as well as those which are obtained through a drawing process after melting and spinning processes and necessarily have undergone the processes of crimping, thermal fixing and cutting into staples. The fibers which experience melt-spinning are almost identical to those which further experience drawing in MI, PI and DSC endothermic peak.

In an embodiment of the preparation of polypropylene filaments or staples according to the present invention, the material polymer is melted in an extruder to give a molten polymer which has a melt index ($MI_b$) with the ratio of $MI_b/MI_a$ ranging from 1.01 to 1.50 and a polydispersity index ($PI_b$) being narrower by 10% than $PI_a$ and more preferably by 5%. A preferable $PI_b$ falls in the range of 2.4 to 5.0.

For example, if $MI_b$ exceeds 1.5 times of $MI_a$, the molecular chain of the polypropylene is so cleaved that its inherent strength cannot be maintained. In addition, such cleavage leads to an insufficient viscosity for the molecular chains to orient at the nozzle, as well as cannot maintain a pressure suitable for spinning. Further, the fibers obtained are poor in strength, so that the non-woven fabrics prepared from the fibers feel harsh to the touch. In result, the productivity becomes poor. An MI change as large as or larger than 1% naturally occurs in the polypropylene upon extrusion. When $MI_b$ is changed to less than 1.01 times of $MI_a$, serious difficulty is found in the preparation process of fibers. Particularly, a high viscosity at the nozzle appears to increase the pressure of the nozzle, making the spinning process very unstable. Accordingly, the production yield is lowered with a serious deviation in fiber quality.

By controlling the quenching condition after the spinning, the polymer which has undergone an MI change in extruding process, is allowed to be secondarily changed in MI. The MI change at a quenching step is determined depending on the temperature of the delayed quenched region, the atmosphere, the temperature, speed and quantity of quenching air. U.S. Pat. No. 4,193,961 describes the use of delay quenching and quenching air, which may also be referred to other documents, for example, M. Ahmed "Polypropylene Fibers-Science and Technology" sponsored by Society of Plastics Engineers, Inc.

In accordance with the preparation of the present invention, the fibers which experience the quenching step are preferably controlled to have a melt index ($MI_c$) 1.65–7.50 times as large as the melt index ($MI_a$) of the material polymer and a polydispersity index ($PI_c$) narrower by 20% or less than that ($PI_a$) of the material polymer (that is, amounts to $0.80 \times PI_a$ or wider). The fibers preferably range, in $PI_c$, from 2.1 to 5.7, more preferably from 2.3 to 4.5 and most preferably from 3.0 to 4.0.

When the $MI_c$ is over the above range, the strength of the grey yarns is deteriorated. The making of non-woven fabrics from the grey yarns suffers from poor workability because the non-woven fabrics are apt to be contaminated with card clothing and partially melted on the calender roll. In detail, if the $MI_c$ deviates from the upper limit, the yarn has a too greatly decreased molecular weight and the quenching effect after the spinning from a nozzle is decreased to generate fusion between yarns. Where the yarns are used to make non-woven fabrics after being forcibly prepared in spite of the above conditions, much powder is generated from the poor yarns in an opening and a carding process, having a negative influence on the making process. In addition, heat-vulnerable portions of the poor yarns are melt out upon calendering, making dirty the surface of the calender roll which plays a role in the final thermal bonding of the non-woven fabrics.

On the other hand, if the $MI_c$ is beyond the lower limit, the strength of the grey yarn is improved, but it is difficult for such grey yarns to improve the thermal bonding index (hereinafter referred to as "TBI") to a desired extent. That is, the non-woven fabrics obtained show low TBI and feel harsh to the touch. Although the strength or TBI of the non-woven fabrics can be improved by increasing the temperature of the calender roll or the thermal bonding area, the non-woven fabrics still remain harsh.

Upon the making of non-woven fabrics, their machine direction orientation and cross direction strengths vary depending on the kinds and arrangements of carding machines. Differences may be found in the machine direction and cross direction strengths of the non-woven fabrics which have passed through carding machines if these machines are manufactured by different manufacturers. Even in the carding machines manufactured by the same manufacturers, the non-woven fabrics show different physical properties in dependence on the shape and material of carding clothing and the presence of random rolls. In addition, the non-woven fabrics are different in plan weight, depending on the requirements for the after-process. The measured strength values of the non-woven fabrics represent simple tenacity and their units are characteristically different from one company to another. Therefore, since there may occur a case in that superiority cannot be discriminated therebetween, the simple tenacity is unsuitable to determine whether the physical properties of the non-woven fabrics are improved. However, the structure and inherent physical properties of the yarn or staple can be compared as to the influence on the non-woven fabrics by reference to the bonding indexes of the non-woven fabrics prepared although a difference may exist in kinds or arrangements of the carding machines.

In accurately determining the influence of the physical properties of yarns or staples on the non-woven fabrics thereof, therefore, the concept of TBI is recognized as very proper. A detail of TBI is described in an article concerning Polypropylene Fibres and Textiles, reported in the Fourth International Conference held by The Plastics and Rubber Institute. Indeed, TBI is introduced in the present invention as the most valuable parameter to comparatively determine the influence of the physical properties of yarns or staples on the non-woven fabrics.

Of the fibers of the present invention, the non-woven fabrics can be made which are 2.0 or higher in TBI with good softness.

A better understanding of the present invention may be obtained in light of the following examples which are set forth to illustrate, but are not to be construed to limit the present invention.

In the following Examples, fibers and non-woven fabrics suggested in the present invention were analyzed for physical properties.

Figure 2:
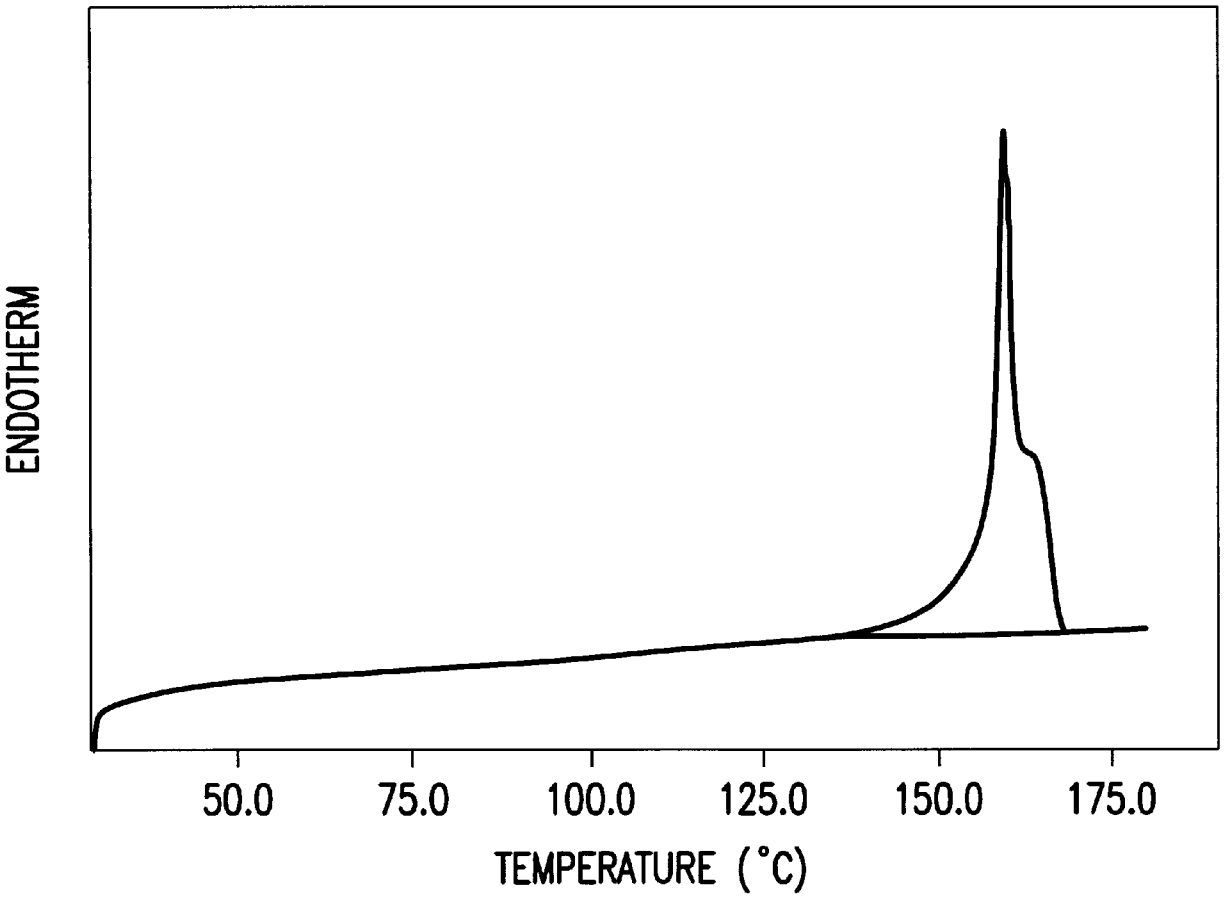
FIG. 2 is a DSC endothermic curve in which two endothermic peaks apparently appear with the secondary peak being in a shoulder form of the primary peak.
Figure 3:
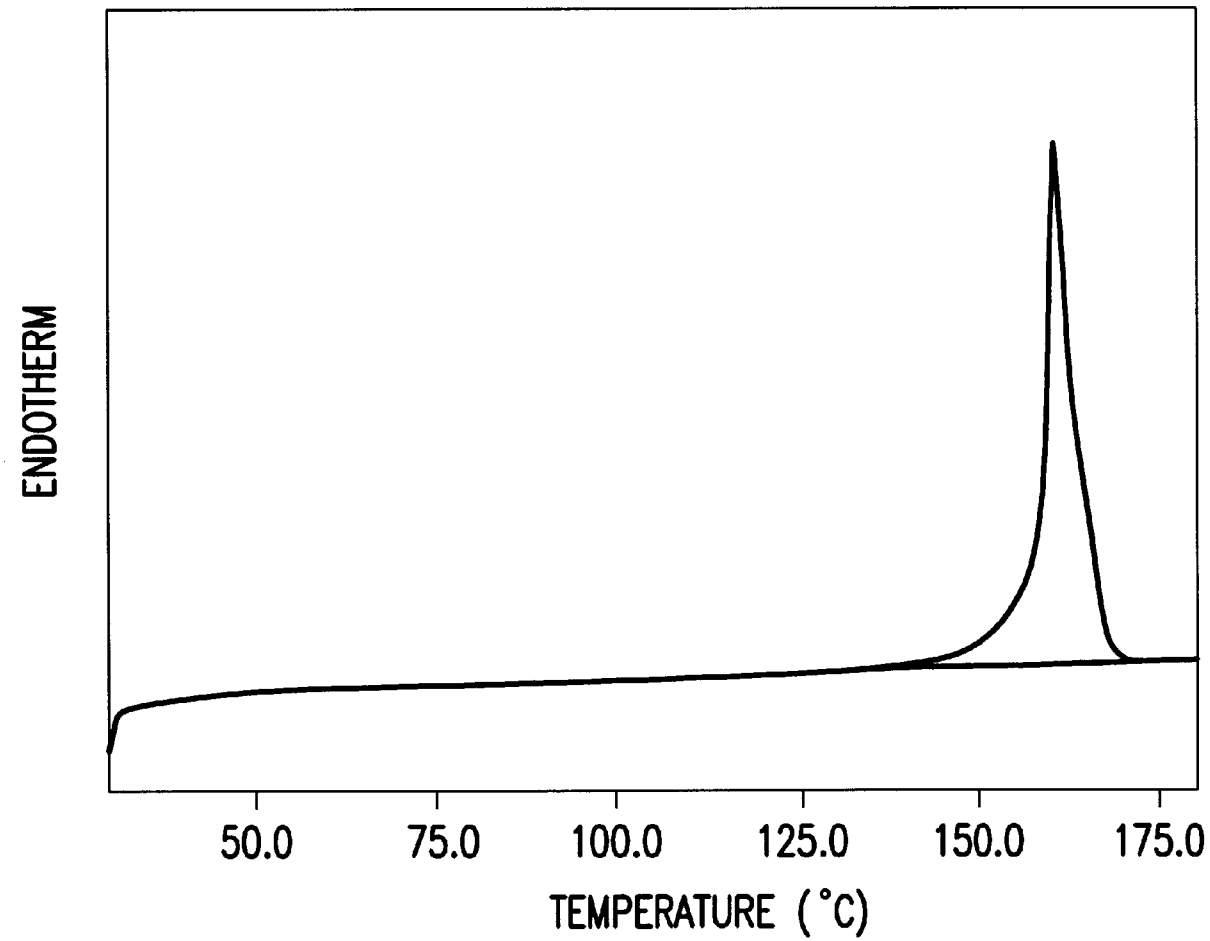
FIG. 3 is a DSC endothermic curve in which only one DSC endothermic peak appears in a conventional polypropylene homopolymer fiber.

DSC endothermic Peaks: fiber samples were sufficiently washed to remove oiling agents. After being dried for 30 min in the air, the samples were vacuum-dried or 1 hour in a decicater and cut into a length of 2–4 mm. The cut samples of 5 mg were put on a measuring pan, which was then subjected to thermal analysis using the Perkin Elmer 7 series Thermal Analysis System in which the temperature was elevated at a rate of 5° C./min from 30° C. to 190° C., so as to obtain endothermic curves. Other conditions of this measurement were accorded with ASTM 3418–82 method. Conventional polypropylene homopolymer fibers showed single endothermic peaks while the fibers of the present invention have double endothermic peaks, as exhibited in the accompanying drawings. FIG. 1 shows two apparent DSC endothermic peaks of the fiber according to the present invention and FIG. 2 shows that a secondary DSC endothermic peak appears in a shoulder form of a primary DSC endothermic peak. FIG. 3 is an endothermic curve showing that only one DSC endothermic peak appears in a conventional fiber.

Denier of Yarn and Staple: measured using Vibroskop, manufactured by Lenzing.

Strength and Elongation of Yarn and Staple: measured using Vibrodyn, manufactured by Lenzing, according to ASTM D 638.

Melt Index (MI): measured using Model MP 993 of Tinius Olsen, according to ASTM D 1238. For the measurement of MI, the fiber samples were washed with copious water, centrifuged, dried at 105° C. for 15 min in an oven and cut into 1 cm.

Polydispersity Index (PI): using Model RMS-800(Disk parallel plate) of Rheometrics, U.S.A., $G_c$ was measured at 200° C. at a shear rate of 0.1–100 under a 10% strain condition and substituted into the following equation.

$$PI = \frac{10^6}{G_c}$$

wherein $G_c$ is a modulus of a point at which a storage modulus (G') and a loss modulus (G") are crossed with each other at two to six frequencies in a frequency range of 5–250 Hz. When there occurred no cross points, $G_c$ was determined by extrapolation.

Isotactic Index (I.I.): a polypropylene homopolymer sample was cut into a length of 5 mm, washed with water, and dried at 105° C. for 1 hour in an oven. After taking about 5 g and then being accurately weighed, a portion of the dried sample was boiled for about 5 hours in heptane for extraction. After completion of the extraction, the sample was sufficiently washed with water, dried at 105° C. for 1 hour in an oven and then weighed. The weights measured before and after the extraction were substituted in the following equation to yield the isotactic index.

$$\text{Isotactic Index (\%)} = \frac{\text{Weight After Extraction}}{\text{Weight Before Extraction}} \times 100$$

Thermal Bonding Index (TBI) of Non-Woven Fabric: calculated according to the following mathematical equation:

$$TBI = (MD \times CD)^{1/2} \times \frac{20}{\text{Plan Weight}}$$

wherein, MD is a machine direction strength (kg/50 mm), CD is a cross direction strength (kg/50 mm), and plan weight is a weight per area of a non-woven fabric.

Strength of Non-Woven Fabric: samples with a dimension of 50 mm width and 140 mm length were measured at a tensile speed of 100 mm/min using an instron.

Softness: the feeling to the touch was graded: 1 very harsh; 2 harsh; 3 ordinary; 4 soft; 5 very soft.

EXAMPLES 1 TO 7 AND COMPARATIVE EXAMPLES 1 TO 7

Isotactic polypropylene homopolymers with an isotactic index of 97% and MI as indicated in Table 1, below, containing an antioxidant and stabilizer at an amount of 0.09 wt %, were melt-spun at an extruder temperature from 250 to 290° C. while the heating in the range from the extruder to the nozzle was controlled in the range of 285–310° C. by means of a heating medium to allow the melt to have $MI_b$ as indicated in Table 1, below. For the comparison of MI between the raw material and the melt before the nozzle, a bypass was set to take the samples while a minimization was provided to the pressure just before a gear pump which served to constantly feed the melt into the nozzle.

Next, the melt was extruded at a spinning rate of 1,500 m/min through a spinneret, passed through a heat reserving zone for delayed quenching and then quenched to afford primary yarns of 2.4 deniers, which had MIs, PIs and DSC endothermic peaks as shown in Table 1.

The primary yarns thus obtained were collected in a bundle and drawn at a drawing ratio of 1.5 times while being crimped in a crimper, following cutting them to staples 40 mm long.

Given in Table 2 are MI, PI, fiber strength, number of crimps and DSC endothermic peaks of the staples obtained.

In order to prepare non-woven fabrics, the staples were applied to the carding machines according to manufacturers. The upper roll used for the preparation of non-woven fabrics was of a diamond type with a sealing area amounting to 22% while the calender roll performed its function at 147° C. with a pressure of 95 kg/cm.

The non-woven Fabrics obtained are described concerning plan weight, strength of machine direction and cross direction, TBI and softness in Table 3, below.

TABLE 1

| Nos. Of | Materials | | Melts | | Fibers | | | | $\{1-(PI_c/PI_a)\} \times$ | $\{1-(PI_c/PI_a)\} \times$ | DSC Endothermic Peaks of primary yarn (□) | |
|---|---|---|---|---|---|---|---|---|---|---|---|---|
| Exmpl. | $MI_a$ | $PI_a$ | $MI_b$ | $PI_b$ | $MI_c$ | $PI_c$ | $MI_b/MI_a$ | $MI_c/MI_a$ | 100 (%) | 100 (%) | 1' | 2' |
| 1 | 17.2 | 4.1 | 18.2 | 3.9 | 52.0 | 3.8 | 1.1 | 3.0 | 4.9 | 7.3 | 159.6 | 164.2 |
| 2 | 22 | 3.2 | 23.0 | 3.1 | 56.0 | 2.9 | 1.0 | 2.5 | 3.1 | 9.4 | 160.2 | 164.5 |
| 3 | 12.2 | 5.5 | 18.0 | 5.1 | 57.0 | 4.5 | 1.5 | 4.7 | 7.3 | 18.2 | 159.8 | 165.2 |
| 4 | 12.2 | 6.0 | 17.0 | 5.5 | 36.5 | 4.9 | 1.4 | 3.0 | 8.3 | 18.3 | 158.9 | 164.8 |
| 5 | 13.2 | 4.3 | 15.0 | 3.9 | 45.0 | 3.6 | 1.1 | 3.4 | 9.3 | 16.3 | 160.1 | 163.9 |
| 6 | 11.0 | 3.8 | 14.6 | 3.6 | 46.0 | 3.5 | 1.3 | 4.2 | 5.3 | 7.9 | 160.0 | 166.2 |
| 7 | 11.0 | 5.8 | 13.6 | 5.6 | 31.2 | 4.9 | 1.2 | 2.8 | 3.4 | 15.5 | 159.5 | 164.2 |
| C.1 | 12.2 | 2.4 | 17.0 | 2.3 | 24.3 | 2.2 | 1.4 | 2.0 | 4.2 | 8.3 | 159.8 | — |
| C.2 | 17.1 | 10.8 | 29.2 | 9.5 | 106.5 | 6.5 | 1.7 | 6.2 | 12.0 | 39.8 | 160.2 | — |
| C.3 | 3.9 | 6.5 | 5.6 | 6.4 | 32.5 | 5.1 | 1.4 | 8.3 | 1.5 | 21.5 | 160.2 | — |
| C.4 | 12.2 | 5.5 | 15.4 | 4.9 | 80.2 | 4.7 | 1.3 | 6.6 | 10.9 | 14.5 | 159.2 | — |
| C.5 | 8.1 | 5.6 | 11.6 | 5.1 | 28.0 | 4.2 | 1.4 | 3.5 | 8.9 | 25.0 | 160.0 | — |
| C.6 | 10.8 | 12.0 | 19.1 | 11.0 | 39.5 | 10.2 | 1.8 | 3.7 | 8.3 | 15.0 | 159.9 | — |
| C.7 | 42.5 | 5.9 | 62.4 | 5.7 | 698.0 | 5.1 | 1.5 | 4.7 | 8.4 | 13.6 | 159.8 | — |

TABLE 2

| Nos. of | $MI_c$ | | $PI_c$ | | Strength | Crimp | DSC Endothermic Peaks of stable (□) | |
|---|---|---|---|---|---|---|---|---|
| Exmpl. | Fiber Spun | Staple drawn After spin | Fiber spun | Staple drawn After spin | of Fiber (g/d) | Nos. | 1' | 2' |
| 1 | 52.0 | 51.0 | 3.8 | 3.7 | 1.9 | 7.7 | 159.4 | 164.2 |
| 2 | 56.0 | 55.0 | 2.9 | 2.8 | 2.2 | 6.2 | 160.1 | 164.5 |
| 3 | 57.0 | 57.6 | 4.5 | 4.5 | 2.3 | 6.4 | 159.7 | 165.8 |
| 4 | 36.5 | 36.9 | 4.9 | 5.0 | 1.9 | 6.4 | 158.9 | 165.1 |
| 5 | 45.0 | 44.0 | 3.6 | 3.8 | 2.4 | 7.2 | 160.2 | 164.1 |
| 6 | 46.0 | 47.3 | 3.5 | 3.4 | 2.2 | 6.2 | 159.8 | 165.8 |
| 7 | 31.2 | 33.0 | 4.9 | 4.8 | 2.6 | 5.9 | 159.9 | 163.7 |
| C.1 | 24.3 | 24.3 | 2.2 | 2.3 | 2.2 | 7.5 | 160.1 | — |
| C.2 | 106.5 | 104.2 | 6.5 | 6.5 | 1.7 | 7.6 | 160.2 | — |
| C.3 | 32.3 | 33.6 | 5.1 | 5.2 | 2.2 | 6.5 | 160.3 | — |
| C.4 | 80.2 | 81.2 | 4.7 | 4.9 | 1.9 | 8.1 | 160.4 | — |
| C.5 | 28.0 | 29.3 | 4.2 | 4.3 | 2.1 | 6.9 | 160.1 | — |
| C.6 | 39.6 | 41.2 | 10.2 | 10.3 | 1.6 | 7.2 | 160.2 | — |
| C.7 | 201.0 | 197.0 | 5.1 | 5.2 | 1.7 | 6.5 | 160.1 | — |

TABLE 3

| Nos. of | Carding | | Plan | Strength (kg/5 cm) | | | | |
|---|---|---|---|---|---|---|---|---|
| Exmpl. | Machines | Speed (m/min) | Wt. ($g/m^2$) | MD | CD | TBI | Softness | Notes |
| 1 | THIBEAU | 180 | 21.0 | 5.3 | 1.4 | 2.6 | 5 | — |
| 2 | SPINNBAU | 175 | 19.0 | 5.2 | 1.2 | 2.6 | 4 | — |

TABLE 3-continued

| Nos. of Exmpl. | Carding Machines | Carding Speed (m/min) | Carding Plan Wt. (g/m²) | Strength (kg/5 cm) MD | Strength (kg/5 cm) CD | Strength (kg/5 cm) TBI | Softness | Notes |
|---|---|---|---|---|---|---|---|---|
| 3 | SPINNBAU | 100 | 19.5 | 7.2 | 2.6 | 4.4 | 5 | — |
| 4 | SPINNBAU | 210 | 17.8 | 6.2 | 1.5 | 3.4 | 4 | — |
| 5 | HERGETH | 95 | 20.1 | 4.9 | 1.8 | 3.0 | 5 | — |
| 6 | HERGETH | 95 | 22.1 | 6.8 | 1.8 | 3.2 | 4 | — |
| 7 | HERGETH | 180 | 20.3 | 3.9 | 1.4 | 2.3 | 4 | — |
| C.1 | SPINNBAU | 100 | 20.2 | 3.2 | 0.9 | 1.7 | 1 | Harsh |
| C.2 | HERGETH | 150 | 21.0 | 3.5 | 0.8 | 1.6 | 3 | TBI □ |
| C.3 | SPINNBAU | 150 | 20.3 | 3.4 | 0.9 | 1.7 | 1 | TBI □ |
| C.4 | SPINNBAU | 160 | 20.4 | 3.5 | 1.0 | 1.8 | 2 | TBI □ |
| C.5 | SPINNBAU | 100 | 19.8 | 3.8 | 0.9 | 1.9 | 2 | Harsh |
| C.6 | SPINNBAU | 105 | 18.9 | 3.9 | 0.8 | 1.9 | 2 | Harsh |
| C.7 | SPINNBAU | 90 | 19.5 | 3.8 | 0.9 | 1.9 | 3 | Difficult, much NEP |

As apparent from the above examples, the non-woven fabrics, which are prepared by thermally bonding the isotactic polypropylene homopolymer fibers having two DSC endothermic peaks in accordance with the present invention, show excellent strength in addition to being soft. Also, the non-woven fabrics can be produced in high speed carding machines. Consequently, the present invention allows the production of high quality non-woven fabrics with a high yield.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method for preparing polypropylene fibers, comprising the steps of:

(a) melting an isotactic polypropylene homopolymer with an isotactic index of 90–99%, a melting index ($MI_a$) of 10.0–40.0 and a polydispersity index ($PI_a$) of 2.5–6.0 to give a molten polymer which has a melt index ($MI_b$) with the ratio of $MI_b/MI_a$ ranging from 1.01 to 1.50 and a polydispersity index ($PI_b$) narrower by 10% or less than the $PI_a$;

(b) spinning the molten polymer to produce fibers with a melting index ($MI_c$) of 16.5–80.0 and a polydispersity index ($PI_c$) narrower by 20% or less than the $PI_a$, the ratio of $MI_c/MI_a$ ranging from 1.65 to 7.50; and (c) optionally drawing the fibers.

2. A method as set forth in claim 1, wherein the polypropylene homopolymer contains a stabilizer and/or an antioxidant at an amount of 0.03–2.0 wt % in the step (a).

3. A method as set forth in claim 1, wherein the $MI_a$ ranges from 10 to 30.

4. A method as set forth in claim 1, wherein the $PI_a$ ranges from 2.8 to 5.0.

5. A method as set forth in claim 4, wherein the $PI_a$ ranges from 3.5 to 4.3.

6. A method as set forth in claim 1, wherein the fibers range, in fineness, from 1.0 to 80.0 denier per filament.

7. A method as set forth in claim 1, wherein $MI_b$ ranges 10.1–41.0.

8. A method as set forth in claim 1, wherein the fiber has the $PI_c$ of 2.1–5.7.

9. A method as set forth in claim 8, wherein the fiber has the $PI_c$ of 2.3–4.5.

* * * * *